US007325614B2

(12) United States Patent
Elder

(10) Patent No.: US 7,325,614 B2
(45) **Date of Patent: *Feb. 5, 2008**

(54) METHOD FOR RELEASING STUCK DRILL STRING

(76) Inventor: Craig J. Elder, 6632 NW. 110th, Oklahoma City, OK (US) 73162

( * ) Notice: Subject to any disclaimer, the term of this patent is extended or adjusted under 35 U.S.C. 154(b) by 0 days.

This patent is subject to a terminal disclaimer.

(21) Appl. No.: 11/650,700

(22) Filed: Jan. 8, 2007

(65) Prior Publication Data

US 2007/0119591 A1 May 31, 2007

Related U.S. Application Data

(63) Continuation of application No. 10/891,332, filed on Jul. 14, 2004, now Pat. No. 7,163,059.

(51) Int. Cl.
*E21B 31/00* (2006.01)

(52) U.S. Cl. ..... 166/301; 166/98

(58) Field of Classification Search ..... 166/301, 166/98, 99

See application file for complete search history.

(56) References Cited

U.S. PATENT DOCUMENTS

| | | | | |
|---|---|---|---|---|
| 1,557,480 | A | 10/1925 | Plante | |
| 3,104,707 | A * | 9/1963 | Overly | 166/301 |
| 3,191,683 | A | 6/1965 | Alexander | |
| 3,246,696 | A * | 4/1966 | Fox, Jr. | 166/301 |
| 3,268,003 | A | 8/1966 | Essary | |
| 3,765,487 | A | 10/1973 | McEver | |
| 4,007,789 | A | 2/1977 | Clampitt | |
| 4,033,414 | A | 7/1977 | Stroble | |
| 4,368,787 | A | 1/1983 | Messenger | |
| 4,448,250 | A | 5/1984 | Cooke, Jr. | |
| 4,464,269 | A | 8/1984 | Walker et al. | |
| 4,494,610 | A | 1/1985 | Walker | |
| 4,614,235 | A | 9/1986 | Keener et al. | |
| 4,865,125 | A | 9/1989 | De Cuir | |
| 5,260,268 | A | 11/1993 | Forsberg et al. | |
| 6,148,917 | A | 11/2000 | Brookey et al. | |
| 6,167,970 | B1 | 1/2001 | Stout et al. | |
| 6,435,276 | B1 | 8/2002 | Kercheville et al. | |
| 6,640,899 | B2 | 11/2003 | Day et al. | |
| 6,662,871 | B2 | 12/2003 | Kercheville et al. | |
| 7,163,059 | B2 * | 1/2007 | Elder | 166/301 |

* cited by examiner

*Primary Examiner*—William P Neuder
(74) *Attorney, Agent, or Firm*—Dunlap Codding & Rogers

(57) ABSTRACT

A method for releasing a drill string stuck against a wall of a well bore due to pressure differential between the hydrostatic pressure of a fluid in the well bore and the pressure of a formation at the point where the drill string is stuck. The method includes injecting a first fluid into the annulus via the drill string and simultaneously injecting a second fluid into the annulus at an upper end of the annulus. The first fluid and the second fluid are injected into the annulus at a volume and rate sufficient to cause at least one of the first fluid and the second fluid to penetrate the formation and increase the pressure of the formation adjacent the well bore so that the pressure of the formation adjacent the well bore is substantially equalized with the pressure of the well bore. A jarring force is simultaneously exerted to the drill string to cause the drill string to release.

22 Claims, 5 Drawing Sheets

METHOD FOR RELEASING STUCK DRILL STRING

CROSS REFERENCE TO RELATED APPLICATIONS

This application is a continuation of U.S. Ser. No. 10/891,332, filed Jul. 14, 2004 now U.S. Pat. No. 7,163,059, which is hereby expressly incorporated by reference herein in its entirety.

BACKGROUND OF THE INVENTION

1. Field of the Invention

The present invention relates generally to a method for releasing a stuck drill string, and more particularly, but not by way of limitation, to an improved method for releasing a drill string that is stuck due to differential pressure.

2. Brief Description of Related Art

The drilling of oil and gas wells by rotary techniques involves the circulation of a drilling fluid through a drill string. The drill string or drill stem is made up of a plurality of joints of pipe connected to one another. A drill bit is connected to the end of the joints of pipe for drilling a well bore in the earth. A problem sometimes encountered while drilling a well bore is that the drill string will become stuck whereby the drill string is unable to be moved up and down through the well bore. Some of the reasons for the drill string getting stuck include foreign objects in the hole, key-seating, and sloughing formations. However, a situation known as pressure differential sticking is, for most drilling organizations, the greatest drilling problem worldwide in terms of time and financial cost.

Pressure differential sticking occurs when the pressure differential between the column of drilling fluid and a permeable formation exerts a considerable force against the drill pipe and literally pins the drill string to the bore wall. That is, the hydrostatic pressure of the column of drilling fluid exerts a greater force on the pipe than the force exerted on the pipe by the formation pressure thereby holding the drill pipe against the bore wall.

Various techniques have been previously employed to attempt to get differentially stuck pipe free. These techniques includes decreasing the pressure differential between the well bore and the formation, placing a spotting fluid next to the stuck zone for the purposes of trying to breakup the mud cake around the drill string, and applying a shock force just above the stick point by mechanical jarring, or a combination of all the above.

When decreasing the pressure differential, it has long been the practice to decrease the hydrostatic pressure of the mud column by replacing the drilling fluid with a less dense fluid thereby allowing for less pressure differential to exist between the bore hole and formation. A problem that may be encountered with this technique is that to decrease the pressure in the well bore sufficiently to cause the drill string to be released may not allow formation pressures to be adequately controlled whereby formation fluids enter the well bore and migrate to the surface.

Other methods of decreasing the pressure differential between the well bore and the formation have been proposed. These methods involve forming perforations in the drill string at the point where the drill string is stuck. Fluid is then injected down the drill string and out the perforations in an attempt to remove debris and equalize the pressure between the well bore and the formation by injecting fluid into the formation. In theory these methods would appear to be effective, but in practice they have met with little success. The number and size of the perforations formed in the drill string do not allow for a sufficient volume of fluid to be injected into the formation to achieve the desired goal.

Spotting fluids are designed to cause the filter cake to crack and shrink thereby reducing the adhesive forces of the filter cake. The spotting fluid further lubricates the area between the pipe and borehole resulting in less friction and quicker release. More often than not, an extensive period of time is necessary for this to occur which results in an expensive loss of rig time.

To this end, a need exists for an improved method of releasing a drill string that is differentially stuck. It is to such an improved method that the present invention is directed.

DETAILED DESCRIPTION OF THE INVENTION

Figure 1:
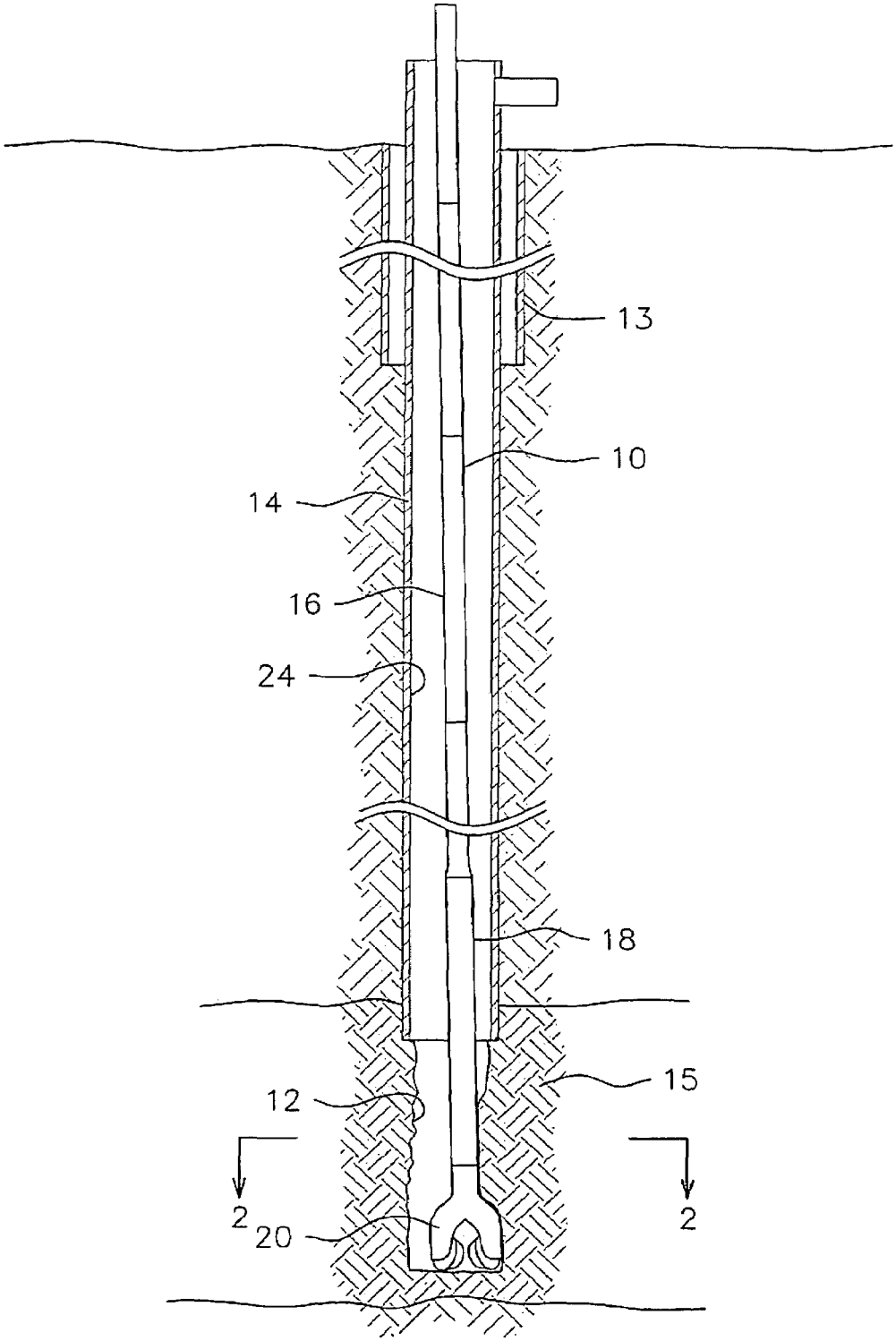
FIG. 1 is a sectional view of a well bore in which a drill string is illustrated as being stuck due to differential pressure.
Figure 2:
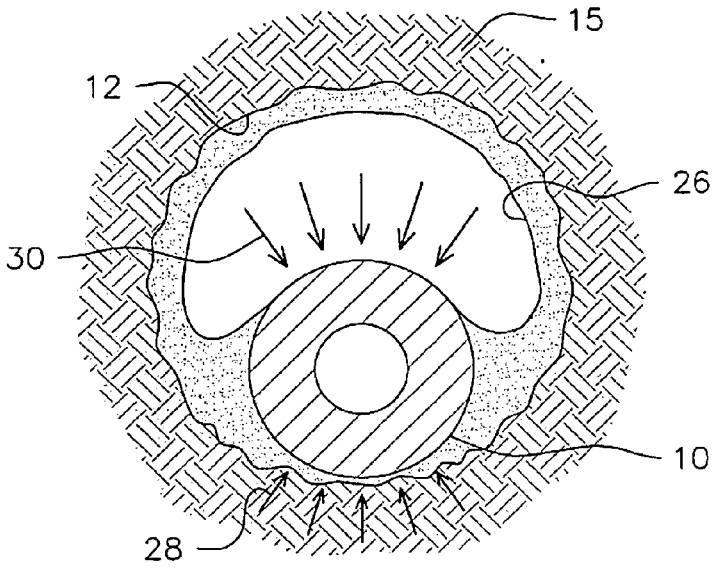
FIG. 2 is a cross sectional view taken along line 2-2 of FIG. 1.

Referring now to the drawings, and more particularly to FIGS. 1 and 2, a drill string 10 is shown disposed in a well bore 12. The well bore 12 is shown to be lined with a surface casing 13 and an intermediate casing 14 that extends down to a formation 15. The drill string 10 typically includes a series of drill pipe 16, a series of drill collars 18, and a drill bit 20. The drill pipe 16 and the drill collars 18 provide fluid communication from the surface to the drill bit 20 such that drilling fluid or other fluids may be pumped from the surface and out a plurality of nozzles (not shown) formed in the drill bit 20. The drill string 10 and the well bore 12 form an annulus 24 which provides fluid communication through the well bore 12 on the exterior side of the drill string 10.

During drilling operations, drilling fluid is pumped down the drill string 10, through the drill bit 20, and up the annulus 24. The drilling fluid functions (1) to cool and lubricate the drill string 10, (2) remove and transport cutting from the bottom of the well bore 12 to the surface, (3) to suspend cutting during times circulation is stopped, (4) to control subsurface pressures, and (5) to wall the well bore 12 with a filter cake. The later of these functions is illustrated in FIG. 2 where the formation of a filter cake 26 is shown. The formation of the filter cake 26 is intended to prevent lost circulation. However, in a low pressure formation, such as a formation 15, where the formation pressure (represented by arrows 28) is less than the hydrostatic pressured exerted in the well bore 12 by the drilling fluid opposite the formation 15, a pressure differential is created. Under these conditions, when the drill string 10 is stationary, as when making a connection, and a portion of the drill string 10 engages the filter cake, the higher pressure of the drilling fluid (represented by arrow 30) may embed the drill string 10 into the filter cake 26. The filter cake 26 acts as a seal to prevent the drilling fluid from contacting the surface of the drill string 10 that is imbedded in the filter cake 26. The difference in pressure between the drilling fluid and the formation is magnified over the surface area of the drill string 10 that is imbedded resulting in a force of possibly several hundred thousand pounds being exerted on the drill string 10.

Figure 4:
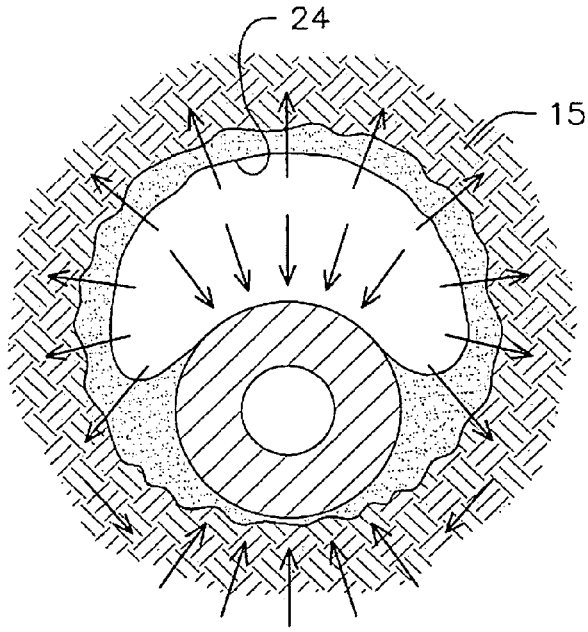
FIG. 4 is a cross sectional view taken along line 4-4 of FIG. 3.
Figure 3:
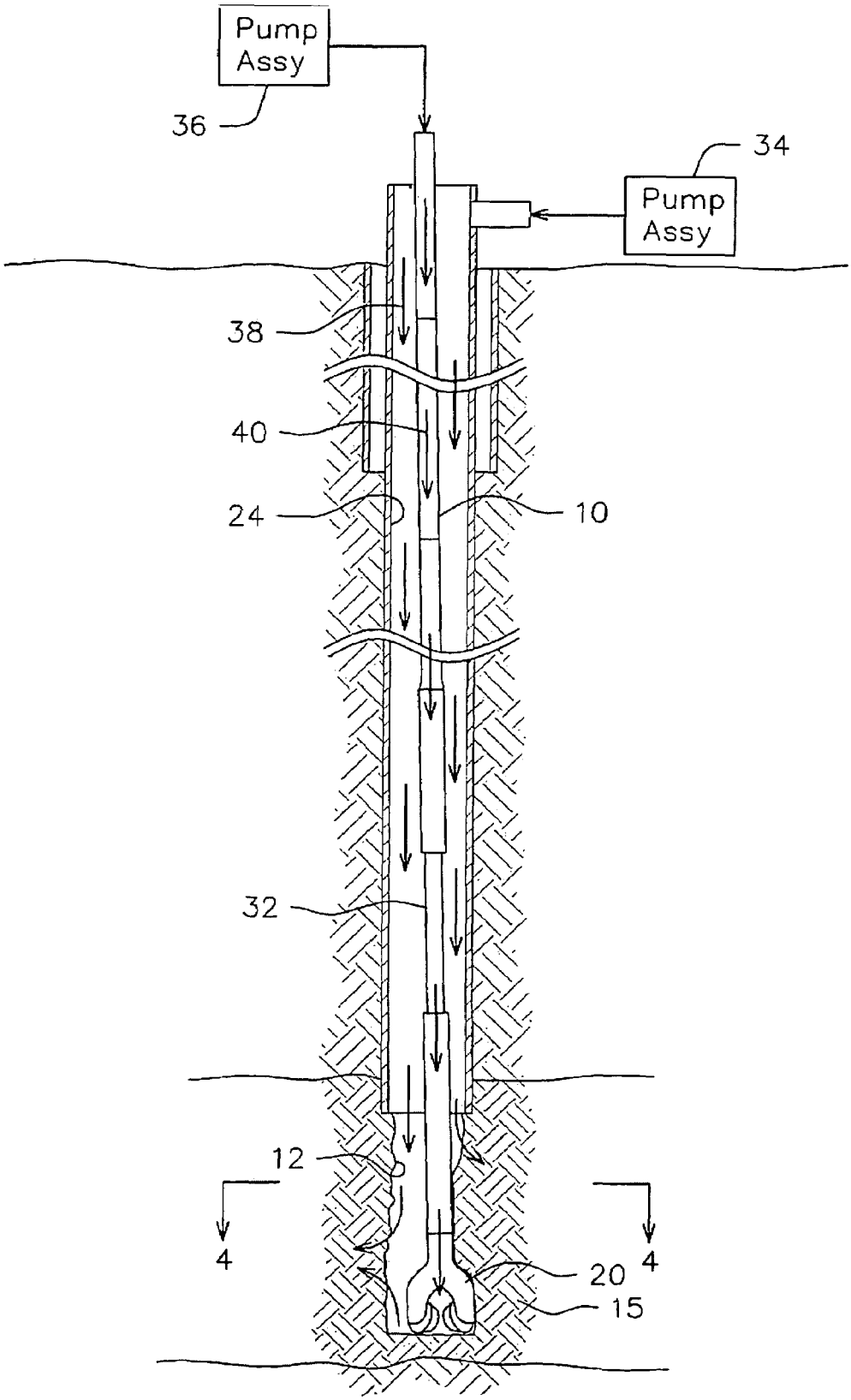
FIG. 3 is a partial schematic, sectional view of the well bore of FIG. 1 illustrating fluid being pumped down the drill string and down the annulus to release the drill string in accordance with the present invention.
Figure 5:
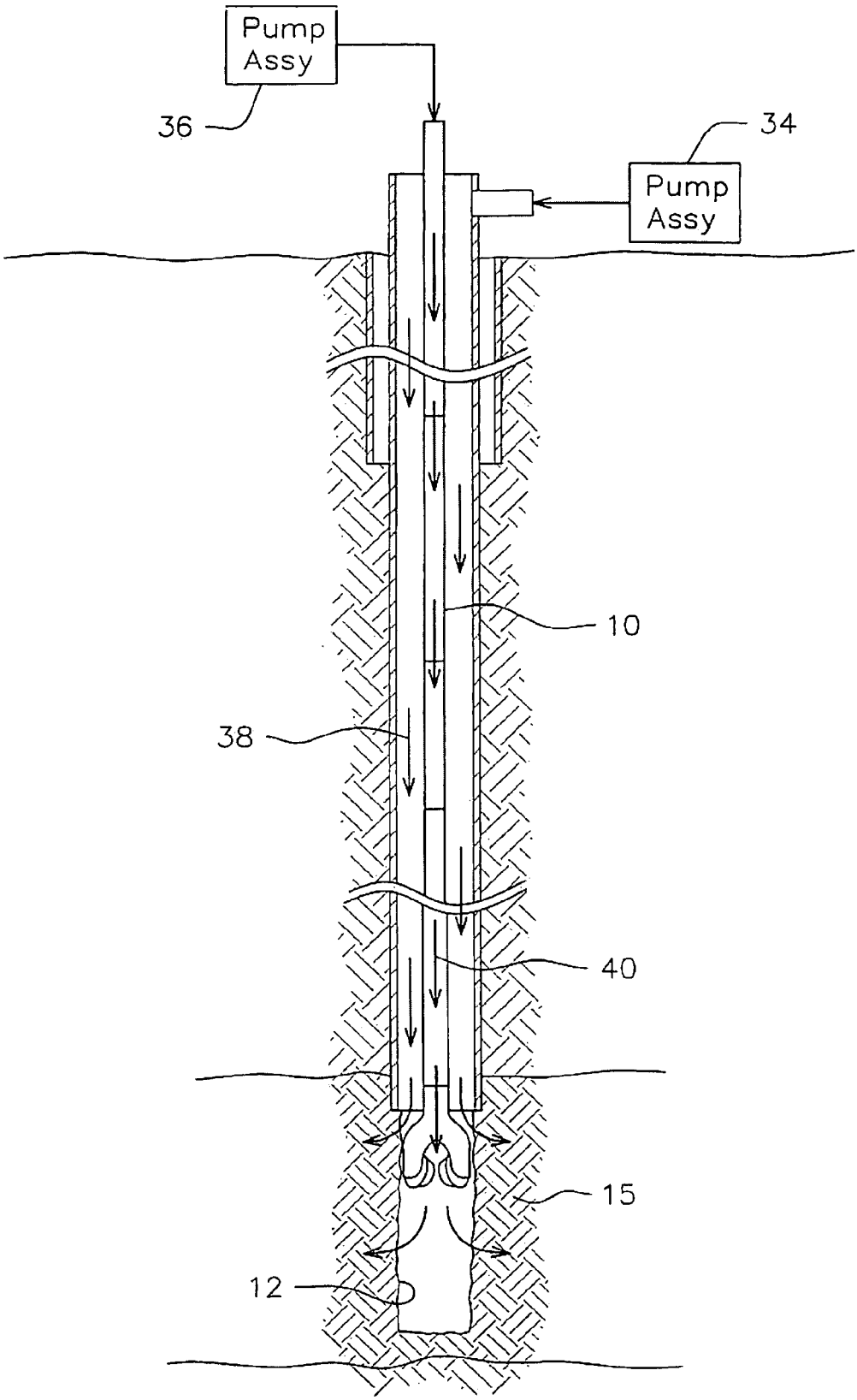
FIG. 5 is a partial schematic, sectional view illustrating the drill string released from being differentially stuck.

Referring now to FIGS. 3-5, the present invention is directed to a method for releasing the drill string 10 when it is stuck against a wall of the well bore 12 due to pressure differential between the hydrostatic pressure of a fluid in the well bore 12 and the pressure of the formation 15 at the point where the drill string 12 is stuck. The method of the present invention includes injecting a first fluid into the annulus 24 via the drill string 10 and simultaneously injecting a second fluid into the annulus 24 at an upper end of the annulus 24. The first fluid and the second fluid are injected into the annulus at a volume and rate sufficient to cause at least a portion of one of the first fluid and the second fluid to penetrate the formation 15 and thereby increase the pressure of the formation 15 adjacent the well bore 12 so that the pressure of the formation 15 adjacent the well bore 12 is substantially equalized with the pressure of the well bore 12.

Once it is determined that the drill string 10 is stuck, in one embodiment, a suitable fluid such as water or oil, is circulated through the well bore 12 to remove any well-cuttings suspended in the drilling fluid. Next, the free point of the drill string 12 is determined in a conventional manner with a free point indicator. A small explosion can then be set off adjacent a connection of two pipe joints while torque is applied to the pipe joints to unscrew one joint from the other. The shock of the explosion will usually cause the tool joint to back off or unscrew and the section of the drill string 10 above this point can be removed from the well bore 12. In one embodiment, it is preferable that the free end of the drill string 10 be made approximately 100 to 200 feet above where the drill string 10 is stuck.

Next, a jarring apparatus 32 is connected to the drill string 10. The jarring apparatus 32 may be any conventional jarring apparatus, including hydraulic or mechanical. The drill string 10 with the jarring apparatus 32 is then run back into the well bore 12 and screwed back onto that portion of the drill string 10 remaining in the well bore 12. It will be appreciated that the jarring apparatus 32 will permit an upward jarring force to be exerted on the drill string 10 when desired.

A pump assembly 34 is connected to the annulus 24 and a pump assembly 36 is connected to the drill string 10. The pump assembly 34 may be any suitable pump, such as would be used for fracture treatment. Typically, the pump assembly 34 will be in the form of truck mounted pumps and of sufficient number to generate the desired pumping capacity. The pump assembly 36 may be in the form of the drilling rig mud pumps if such pumps are capable of pumping at the desired rate, or the pump assembly 36 may be in the form of conventional truck mounted fracture treatment pumps, or the pump assembly 36 may be a combination of the drilling rig mud pumps and fracture treatment pumps.

After the pump assemblies 34 and 36 are connected to the annulus 24 and the drill string 10, the pump assembly 34 is operated to pump a first fluid 38 down the annulus 24, and the pump assembly 30 is operated to pump a second fluid 40 down the drill string 10 to cause the second fluid 40 to pass out the nozzles of the drill bit 20 and into the annulus 24. In most instances the first fluid 38 and the second fluid 40 will be water, which may include brine. However, if the water sensitive formations are exposed, oil may be used as the first fluid 38 and the second fluid 40.

As mentioned above, the first fluid 38 and the second fluid 40 are injected into the annulus 35 at a volume and rate sufficient to cause at least a portion of one of the first fluid 38 and the second fluid 40 to penetrate the formation 15 and thereby increase the pressure of the formation 15 adjacent the well bore 12 so that the pressure of the formation 15 adjacent the well bore 12 is substantially equalized with the pressure of the well bore 12. To this end, in one embodiment, it is desired to inject fluid into the annulus 24 at as high a rate as possible without damaging the surface casing 13, the intermediate casing 14, the drill string 10, or any other tubulars in the well bore 12. Therefore, the rate at which the first fluid 38 and the second fluid 40 are injected is generally limited by the burst strength of the casing 14 and the drill string 10.

While the rate at which the first fluid 38 and the second fluid 40 are injected depends largely on the thickness, porosity, and permeability of the formation in which the drill string 10, as well as the length and diameter of the annulus 24 and the drill string 10, desirable results may be obtained when the first fluid 38 is injected into the annulus 24 at a rate greater than about 40 bbl/min and the second fluid 40 is injected into the drill string 10 at a rate of about 5-10 bbl/min. Again, the volume of water required to be injected will depend largely on the thickness, porosity, and permeability of the formation in which the drill string 10 is stuck. In most instances, it is believed that a total volume of approximately 1,500 to 3,000 barrels of fluid should be sufficient to pressurize the formation. However, thick, porous formations may require much more fluid volume. In situations where the formation is fractured, or otherwise highly permeable, it may be necessary to mix a gelling solution with the fluid to keep the fluid from dissipating too quickly and thereby allow the pressure in the formation to build more quickly and to be maintained for a longer period of time.

To facilitate the injection of the first fluid 38 and the second fluid 40 and to add lubrication to the drill string 10 and the formation 15, a friction reducer may be mixed with the first fluid 38 and the second fluid 40. The friction reducer may be any suitable chemical additive that alters fluid rheological properties to reduce friction created within the fluid as it flows through small-diameter tubulars or similar restrictions. Generally polymers, or similar friction reducing agents, add viscosity to the fluid, which reduces the turbulence induced as the fluid flows. In one embodiment, the friction reducer is mixed with the first fluid 38 and the second fluid 40 at a relatively high concentration, for example, approximately four times as much friction reducer than would have been used on a conventional fracture treatment with water. However, it will be appreciated that the concentration of the friction reducer may be varied.

While the fluid is being injected into the annulus 24 so as to cause the formation 15 to be pressurized, the drill string 10 should be jarred from time to time via the jarring apparatus 32 in an attempt to free the drill string 10.

As illustrated in FIG. 4, by injecting fluid down both the annulus 24 and the drill string 10 and thus not allowing fluid to be circulated to the surface via the annulus 24, fluid is caused to be injected into the low pressure formation 15 in which the drill string 10 is stuck thereby increasing the pressure of the formation 15. Once the pressure of the formation 15 sufficiently increases as a result of injecting fluid into it, a pressure equalization, or an over pressurization, will result which eliminates the differential pressure problem. Consequently, the periodic jarring should cause the drill string 10 to come free and permit the drill string 10 to be pulled to the surface as illustrated in FIG. 5.

Figure 6:
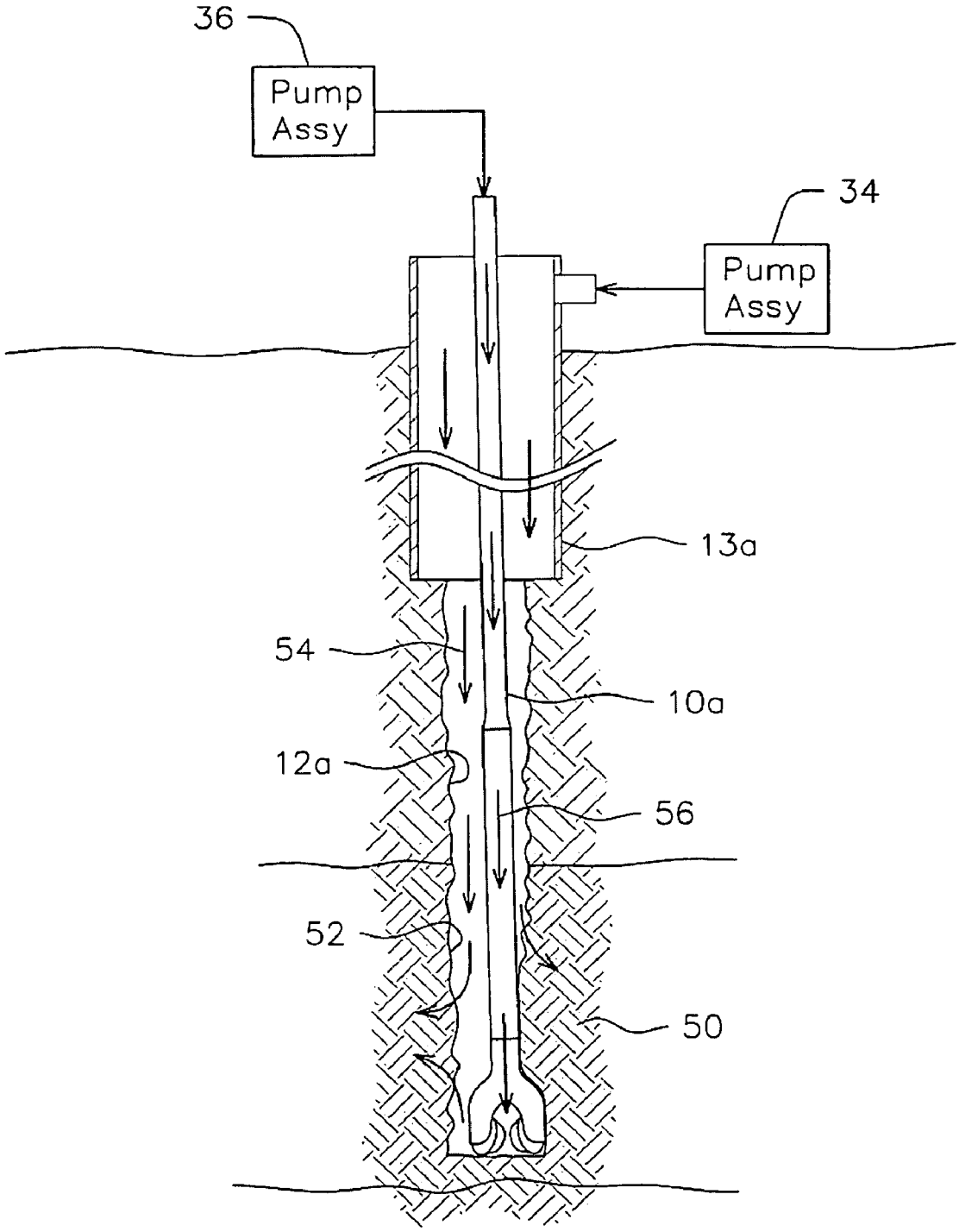
FIG. 6 is a partial schematic, sectional view of another well bore illustrating fluid being pumped down the drill string and down the annulus to release the drill string in accordance with the present invention.

FIG. 6 illustrates a drill string 10*a* shown disposed in a well bore 12*a*. The well bore 12*a* is shown to extend into a formation 50 and to be lined with a surface casing 13*a* only. As such, no intermediate casing has been set in the well bore 12*a*. The drill string 10*a* and the well bore 12*a* form an annulus 52 which provides fluid communication through the well bore 12*a* on the exterior side of the drill string 10*a*. The drill string 10*a* is further illustrated as being differentially stuck in the formation 50 which is a distance below the lower end of the surface casing 13*a*. In this situation, the method for releasing the drill string 10*a* is similar to the method described above for releasing the drill string 10 except as noted below. The primary difference being that the rate at which a first fluid 54 is injected into the annulus 52 is reduced relative to the rate the first fluid 38 of FIG. 3 is injected where an intermediate casing is present, while the rate at which a second fluid 56 is injected into the drill string 10*a* is increased relative to the rate at which the second fluid 40 of FIG. 3 is injected.

Because the well bore 12*a* is open below the surface casing 13*a*, injecting fluid down the annulus 52 at high rates may damage the well bore 12*a* by dislodging filter cake and other solids from the well bore 12*a* above the point where the drill string 10*a* is stuck thereby causing the sticking problem to become worse. To reduce the possibility of causing damage to the open well bore 13*a*, the first fluid 54 is preferably injected into the annulus 52 via the pump assembly 34 at a rate of approximately 3-5 bbl/min, while the second fluid 56 is preferably injected into the drill string 10*a* via the pump assembly 36 at a rate of approximately 40 bbl/min, or at as high a rate as possible without damaging the drill string 10*a*. By injecting fluid into the drill string 10*a* and the annulus 52, fluid is caused to penetrate the low pressure formation 50 to alleviate or eliminate the pressure differential rather that be circulated back up the annulus 52.

The present method is illustrated as freeing a vertically oriented drill string. However, it should be appreciated that the present invention is not intended to be limited to such use. The present invention may also be used to release horizontally oriented drill strings, as well as tubulars other than drill strings, differentially stuck down hole.

Changes may be made in the combinations, operations and arrangements of the various parts and elements described herein without departing from the spirit and scope of the invention as defined in the following claims.

What is claimed:

1. A method for releasing a drill string stuck against a wall of a well bore due to pressure differential between a hydrostatic pressure of a fluid in the well bore and a pressure of a formation at the point where the drill string is stuck, the drill string and the well bore forming an annuls the method comprising:

injecting a first fluid into the annuls via the drill string; and injecting a second fluid into the annulus at an upper end of the annulus, wherein the first fluid and the second fluid are injected into the annulus at a volume and rate sufficient to cause at least a portion of one of the first fluid and the second fluid to penetrate the formation and thereby increase the pressure of the formation adjacent the well bore so that the pressure of the formation adjacent the well bore is substantially equal to or greater than the pressure of the well bore.

2. The method of claim 1 wherein the drill string includes a drill bit on a lower end thereof, and wherein in the step of injecting the first fluid, the first fluid is injected into the annulus via the drill bit.

3. The method of claim 1 wherein the first fluid is injected into the annulus at rate of at least about five bbl/min.

4. The method of claim 3 wherein the second fluid is injected into the annulus at a rate greater than about forty bbl/min.

5. The method of claim 1 wherein the first fluid is injected into the annulus at rate of at least about forty bbl/min.

6. The method of claim 5 wherein the second fluid is injected into the annulus at a rate in a range of from about three bbl/min to about six bbl/min.

7. The method of claim 1 wherein the first fluid and the second fluid are water.

8. The method of claim 7 wherein the first fluid and the second fluid include a friction reducer.

9. The method of claim 8 wherein the first fluid and the second fluid include a gel.

10. The method of claim 1 wherein the first fluid and the second fluid are oil.

11. The method of claim 10 wherein the first fluid and the second fluid include a gel.

12. A method for releasing a drill string stuck against a wall of a well bore due to pressure differential between a hydrostatic pressure of a fluid in the well bore and a pressure of a formation at the point where the drill string is stuck, the drill string and the well bore forming an annulus, the method comprising:

injecting a first fluid into the annulus via the drill string; and injecting a second fluid into the annulus at an upper end of the annulus, wherein the first fluid and the second fluid are injected into the annulus at a volume and rate sufficient to cause at least one of the first fluid and the second fluid to penetrate the formation and increase the pressure of the formation adjacent the well bore so that the pressure of the formation adjacent the well bore is substantially equal to or greater than the pressure of the well bore; and simultaneously exerting a jarring force to the drill string.

13. The method of claim 12 wherein the drill string includes a drill bit on a lower end thereof, and wherein in the step of injecting the first fluid, the first fluid is injected into the annulus via the drill bit.

14. The method of claim 12 wherein the first fluid is injected into the annulus at rate greater than about five bbl/min.

15. The method of claim 14 wherein the second fluid is injected into the annulus at a rate greater than about forty bbl/min.

16. The method of claim 12 wherein the first fluid is injected into the annulus at rate of at least about forty bbl/min.

17. The method of claim 16 wherein the second fluke is injected into the annulus at a rate in a range of from about three bbl/min to about six bbl/min.

18. The method of claim 12 wherein the first fluid and the second fluid are water.

19. The method of claim 18 wherein the first fluid and the second fluid include a friction reducer.

20. The method of claim 19 wherein the first fluid and the second fluid include a gel.

21. The method of claim 12 wherein the first fluid and the second fluid are oil.

22. The method of claim 21 wherein the first fluid and the second fluid include a gel.

* * * * *